United States Patent [19]

Ziegler et al.

[11] 4,343,099

[45] Aug. 10, 1982

[54] APPARATUS FOR THE PARALLEL GUIDANCE OF THE BUCKET OF A HYDRAULIC EXCAVATOR

[75] Inventors: Mario Ziegler; Ulrich Ziegler, both of Frenkendorf, Switzerland

[73] Assignee: Ziegler AG, Liestal, Switzerland

[21] Appl. No.: 209,206

[22] Filed: Nov. 21, 1980

[30] Foreign Application Priority Data

Nov. 28, 1979 [CH] Switzerland ..... 10563/79

[51] Int. Cl.[3] ..... E02F 5/02

[52] U.S. Cl. ..... 37/103; 414/722; 37/DIG. 20; 137/624.27

[58] Field of Search ..... 37/103, DIG. 1, DIG. 20, 37/118; 414/685, 694, 695.5, 699, 710, 722; 137/561 R, 624.27, 225.6, 625.63

[56] References Cited

U.S. PATENT DOCUMENTS

| | | | |
|---|---|---|---|
| 3,584,751 | 6/1971 | Bellart | 37/103 |
| 4,129,224 | 12/1978 | Teach | 37/DIG. 1 X |
| 4,142,308 | 3/1979 | Brandtjen | 37/103 |
| 4,218,837 | 8/1980 | Peterman | 37/103 |
| 4,277,899 | 7/1981 | Guthoff | 37/103 |

FOREIGN PATENT DOCUMENTS

| | | | |
|---|---|---|---|
| 7708908 | 2/1979 | Netherlands | 37/103 |
| 118342 | 1/1956 | U.S.S.R. | 37/103 |
| 626168 | 8/1978 | U.S.S.R. | 37/DIG. 1 |
| 670696 | 6/1979 | U.S.S.R. | 37/DIG. 1 |
| 692950 | 10/1979 | U.S.S.R. | 37/DIG. 1 |

*Primary Examiner*—E. H. Eickholt

*Attorney, Agent, or Firm*—Watson, Cole, Grindle & Watson

[57] ABSTRACT

In a hydraulic dredger/excavator wherein it is desired to guide the bucket parallel to itself there is provided a control apparatus for positively controlling the necessary changes of angle between the dipper boom (4) and the bucket (5) in dependence on the change of the angle between the boom (2) and the dipper boom (4). The control apparatus has a cam disc (11) on the end of the boom (2) against which the piston rod (13) of a first control cylinder (12) arranged on the dipper boom engages under the effect of a spring (15). Both cylinder spaces or chambers of the double-acting first control cylinder (12) are connected with the corresponding cylinder spaces or chambers of a double-acting second control cylinder (16) via lines or ducts (17, 18). The second control cylinder is arranged to be parallel with the operating cylinder (10) that serves for changing the angle between the dipper boom (4) and the bucket (5). The ducts or lines (17, 18) connecting the control cylinders (12, 16) are connected with pilot valves (20, 25) of a main valve (21) for the operating cylinders (10). When the dipper boom swivels relative to the boom a pressure change arises in the pressure medium within the control cylinders and the pressure changes control the main valve (21) until the desired angle changes are achieved.

8 Claims, 2 Drawing Figures

APPARATUS FOR THE PARALLEL GUIDANCE OF THE BUCKET OF A HYDRAULIC EXCAVATOR

Figure 1:
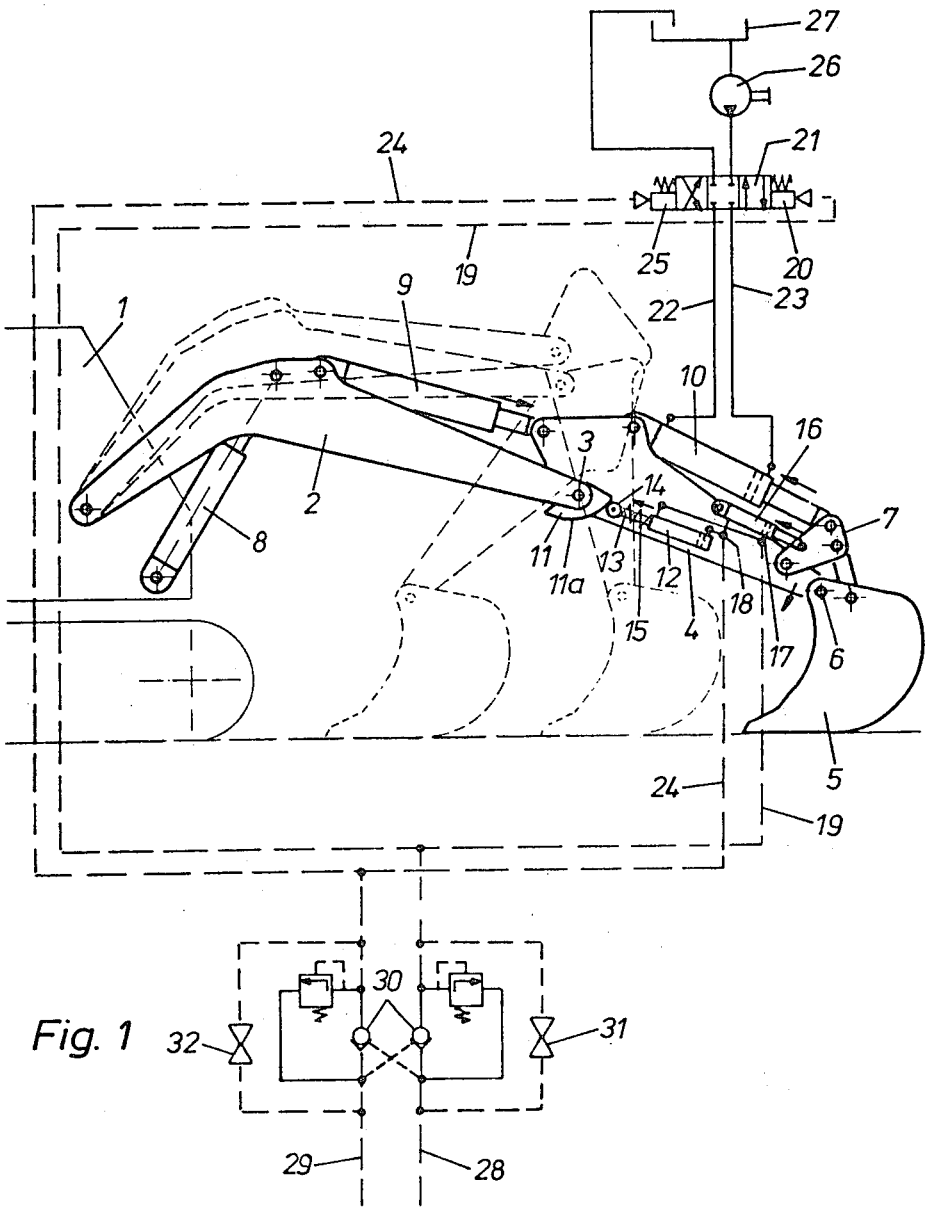

The invention concerns apparatus for the parallel guidance of the bucket of a hydraulic excavator (dredger/excavator) having an excavator frame on which a boom is pivotally journalled and a dipper boom carrying at its end a pivotable bucket is pivotally connected to the boom, wherein the angular position of the boom relative to the excavator frame, the angular position of the dipper boom relative to the boom and the angular position of the bucket relative to the dipper boom are changeable by means of a respective hydraulic operating cylinder or ram.

Since in dredger/excavators of this type the boom, the dipper boom, and the bucket are each individually displaceable and in addition the so-called superstructure of the excavator together with the boom secured thereto is rotatable with the aid of slewing gear, the operator must carry out a total of four control movements for which end in modern dredger/excavators with hydraulic control two control levers are provided; each of these control levers can be moved forwards and backwards as well as in directions at right angles thereto. Thus, for instance, one control lever may be moved forwards and backwards for lowering and lifting the boom, and to the left and to the right for filling and emptying the bucket. Then the other control lever serves to swing the dipper boom out and in by moving it forwardly and backwardly and to rotate the slewing gear by moving it to the left or the right.

Even for ordinary digging work the operation of a dredger/excavator of this type assumes a certain amount of practice from the operator; when moreover it is desired to use the dredger/excavator for levelling or for making a straight slope or to make a straight cut, for which operations the bucket must be guided or kept parallel, the co-ordination of the control movements required for such purposes requires a certain amount of routine from the operator. The operator must in such cases so co-ordinate three movements that during the swinging in and swinging out of the dipper boom, the bucket is pivoted by the correct amount in relation to the dipper boom and simultaneously the boom is raised or lowered by the right magnitude so that during this movement the bucket is guided parallel or level.

The underlying task of the present invention accordingly consists in facilitating the operation of a dredger/excavator of this type so that the parallel guidance of the bucket required for certain kinds of work should be achievable without the ability, which assumes routine or expertise, of accurately co-ordinating the different control movements, so that even unpracticed operators should be able to carry out difficult operations with the excavator. The operation should be facilitated in the sense that at least one, but preferably two of the three required control movements for the parallel guidance of the bucket should not be required to be carried out by the operator.

To solve the above-mentioned task, the apparatus of the above-mentioned type is in accordance with this invention characterised in that at least one of the changes of angle that are simultaneously required for the parallel guidance of the bucket, namely the change in angle between the bucket and the dipper boom and between the boom and the excavator frame, is constrainedly or positively controlled by a control device in dependence on the change of angle between the boom and the dipper boom when the latter is slewed. In a preferred embodiment the control device has first control means for changing the angle between the bucket and the dipper boom and second control means for the simultaneous change of angle between the boom and the excavator frame, wherein the first and second control means mutually independently control a respective operating cylinder in dependence on the change of angle between the boom and the dipper boom, so that during movement in the direction towards and away from the excavator frame, the bucket is constrained to maintain a position parallel to itself.

In an advantageous embodiment, each of the first and second control means has a crank drive for translation of movement with a cam disc and a first double-acting control cylinder connected to a pressure medium system and further, a second double-acting control cylinder, furthermore the first control cylinder has a piston rod which engages the cam disc under spring force, a portion of the crank drive comprising a cam disc and the first control cylinder being rigidly carried by the boom and dipper boom, respectively, in such a manner that in the course of a change of angle between the boom and the power boom the end of the piston rod carrying a rolling body is displaced along the cam disc. Furthermore, in the preferred embodiment the second control cylinder is arranged parallel with and articulated to one of the hydraulic operating cylinders which are respectively articulated between the bucket and the dipper boom and the boom and the excavator frame, and furthermore a main valve for the hydraulic operating cylinders is switchable in opposite directions by means of two pilot valves, each pilot valve being connected with a line connecting the cylinder couplings on the piston rod side of the first and second control cylinders and a line connecting the cylinder couplings on the piston head or crown side; whereby always one of the pilot valves responds to changes in pressure on one or other side of the double-acting first control cylinder. This change in pressure arises because of the displacement of the piston of the first control cylinder through its co-operation with the cam disc, when the boom and the dipper boom change their angular position relative to each other as a consequence of the control movement effected by the operator on the actuating or operating cylinder articulated to and associated with the boom and the dipper boom. The pilot valve responding to the change in pressure actuates the proportionally functioning main valve of the hydraulic operating cylinder by means of which a change in angle is positively controlled. The simultaneously arising change in pressure in the second control cylinder is present so long as the change in angle that is performed, which corresponds to a predetermined change in length of the second control cylinder, has precisely the correct magnitude for the parallel guidance of the bucket, which is achieved by suitably shaping the cam disc. The shape of the control curve of the cam disc may be established empirically but it may also be established by computer calculations.

Figure 2:
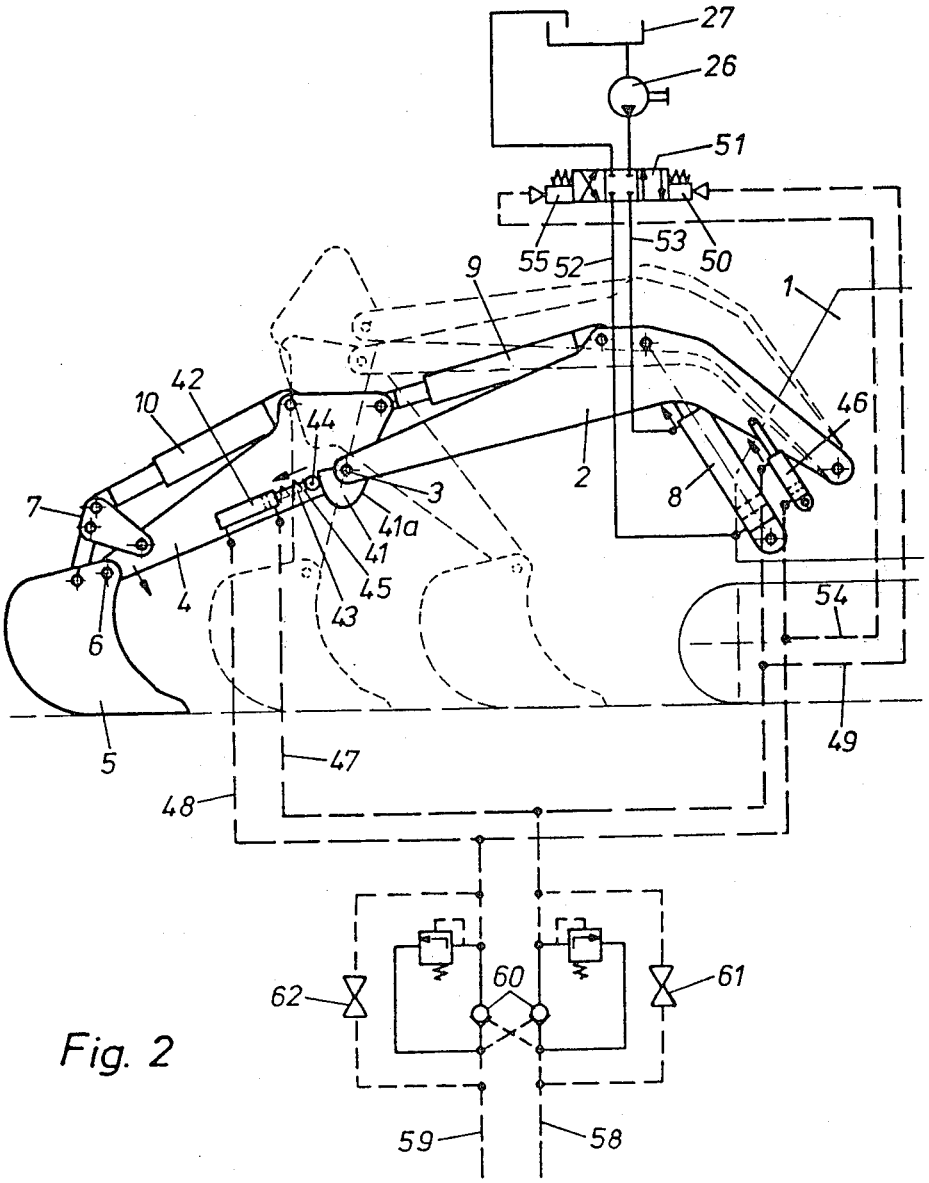

Further details and advantages of the invention will become clear from the following description, and from the drawings, which schematically illustrate a preferred embodiment of the invention and wherein:

FIG. 1 is an elevation of the excavator with the first control means of the control device for the parallel guidance of the bucket; and FIG. 2 is an elevation of parts of the excavator with the second control means of the control device for the parallel guidance of the bucket.

According to FIGS. 1 and 2 which show the excavator together with the control scheme or layout for the parallel guidance of the bucket from opposite sides of the excavator, a boom 2 is pivotally journalled on the excavator frame 1. The end of the boom 2 carries a dipper boom 4 pivotable about an axis of rotation 3. The other end of the dipper boom carries a pivotable bucket 5 which is pivotable about a pivot axis 6 and is articulated to the dipper boom 4 by way of a link member 7.

The angular position of the boom 2 relative to the excavator frame 1 can be changed by means of a ram or operating cylinder 8 the two ends of which are articulated to the excavator frame 1 and the boom 2. The angular position of the dipper boom 4 relative to the boom 2 is changeable by means of a ram operating cylinder 9 the two ends of which are articulated to the boom and the dipper boom, respectively. Furthermore, the angular position of the bucket 5 relative to the dipper boom 4 can be changed by means of a ram or operating cylinder 10 the two ends of which are articulated to the dipper boom 4 and the above-mentioned link member 7. The construction described so far applies to an excavator of normal or customary form which has no control apparatus for the parallel guidance of the bucket so that the three operating cylinders 8, 9 and 10 are mutually independently controllable for carrying out the customary operations or work of the excavator and hence each cylinder is connected to a central control which is not shown in detail in FIGS. 1 and 2. In FIG. 1 only the main valve associated with the operating cylinder 10 is shown and in FIG. 2 only the main valve associated with the control cylinder 8 of this control is shown. It may be seen from FIGS. 1 and 2 that to guide the bucket 5 in parallel when it moves in the direction towards and away from the excavator frame 1 three angles must simultaneously change by predetermined amounts, namely the angle between the excavator frame 1 and the boom 2, the angle between the boom 2 and the dipper boom 4 and the angle between the dipper boom 4 and the bucket 5. These changes in angle are of differing magnitudes. According to the invention, in dependence on one of the changes in angle at least a second, but preferably simultaneously the second and third changes in angle are positively or constrainedly controlled in such a manner that during its movement towards and away from the excavator frame, the bucket is guided parallel or level so that the operator of the excavator is no longer required to carry out at least one but preferably two of the control movements required with excavators which are not equipped with a control apparatus.

FIG. 1 schematically illustrates control apparatus with the first control means for changing the angle between the bucket 5 and the dipper boom 4 in dependence on the change of angle between the boom 2 and the dipper boom 4. The first control means have a crank drive for the translation of motion which crank drive comprises a cam disc 11 which is rigidly arranged at the end of the boom in the vicinity of the axis of rotation 3 for journalling the dipper boom 4 on the boom, and of a double-acting first control cylinder 12. The piston rod 13 of the first control cylinder 12, which carries a roller 14 at its end, is pressed under the effect of a spring 15 against the cam disc 11. The first control means further comprise a second control cylinder 16. This is arranged with one of its ends articulated to the dipper boom 4 and with its other end articulated to the link member 7 and is arranged parallel with the operating cylinder 10, so that it is extended or retracted in the same sense as the latter when the angle between the dipper boom 4 and the bucket 5 is changed. The first and second control cylinders are connected together by means of a duct 17 that connects the piston rod side of the cylinder ends and by means of a duct 18 which connects the cylinder ends on the crown or piston head side. Furthermore, the duct 17 is connected via a line 19 with a pilot valve 20 of the main valve 21 the pilot valve controlling the operating cylinder 10 via lines 22 and 23 connecting the main valve with the operating cylinder. The other duct or line 18 between the first control cylinder 12 and the second control cylinder 16 is connected with a pilot valve 25 of the main valve 21 via a line 24. The main valve 21 is a four-way valve which is switchable or connectable in opposite directions by means of the two pilot valves 20 and 25. In its connection or switch positions, the valve connects one or other side of the operating cylinder 10 with a pump 26 which is coupled to an oil tank 27.

The lines 19 and 24 are connected with lines 28 and 29 coming from the central control that is not illustrated, the lines 28 and 29 having a blockable twinned check valve 30. The valve 30 is unblocked from the pressure side in that the seated valve is lifted on the opposite side in a crossed-over fashion so as to ensure the return flow in the system. With the aid of two cocks 31 and 32 the positive of constrained control for the parallel guidance of the bucket may be disabled so that control may then be carried out individually by hand. In the duct or line system shown in broken lines, a pilot control pressure suitable for actuation of the pilot valves prevails.

The mode of operation of the control apparatus, insofar as it concerns the first control means for changing the angle between the dipper boom 4 and the bucket 5 in dependence on the change of angle between the boom 2 and the dipper boom 4, is as follows: when the operator of the excavator causes the dipper boom 4 to swing in or swing out by operating a control lever provided for this purpose in the cab, the angular position of the dipper boom 4 changes relative to the boom, the piston rod 13 with the piston within the first control cylinder 12 performs a stroke because the piston 13 is pressed by way of the roller 14 at its end against the cam disc 11 under the action of the spring 15 and the control curvature 11*a* on the periphery of the cam disc 11 has a non-constant radial distance from the axis of rotation 3. When the pivotal position of the dipper boom 4 changes from its full line position shown in FIG. 1 to the left into one of the positions shown in broken lines, the piston rod 13 extends so that in the piston rod side cylinder space of the control cylinder 12 the pressure increases, which pressure increase is carried over via the line 17 leading to the second control cylinder 16 and the further line 19 connected to the line 17 to the pilot valve 20 of the main valve 21, whereby the main valve 21 is actuated and connects the operating cylinder 10 with the pump 26, so that the bucket 5 is pivoted in the sense of increasing the angle between the dipper boom 4 and the bucket 5. Simultaneously the volume of liquid displaced by the stroke flows via the line 17 into the second control cylinder 16 the effective length of which changes simultaneously with that of the operating cylinder 10, whereby this change in length corresponding to the swept volume is determined by the associated change of angle between the dipper boom 4 and the bucket 5, by which change of angle the bucket always maintains a position parallel to itself. Since the changes in angle between the boom and the dipper boom and between the dipper boom and the bucket during a full swivelling movement of the dipper boom are different from each other under this condition of the parallel guidance of the bucket, the cam disc 11 must be so constructed that each point of its control surface 11*a* fulfils this condition. The shape of the control curve may be established empirically but it may also be determined by a computer.

In a preferred embodiment of the invention the control apparatus also has a second control means which is schematically illustrated in FIG. 2. This second control means is in its form and mode of operation identical in principle with the first control means the main difference being that it controls the change of angle between the excavator frame 1 and the boom 2 in dependence on the change of angle between the boom 2 and the dipper boom 4 in such a manner that the bucket is guided parallel to itself for which reason the second control means co-operates with the associated operating cylinder 8 for the boom. The description that follows will consequently only be concerned with the differences that are present.

In addition to the cam disc 11 illustrated in FIG. 1 a further cam disc 41 is rigidly arranged at the end of the boom 2 in the vicinity of the axis of rotation 3. The first control cylinder 42 rigidly arranged on the dipper boom 4 has a piston rod 43 which carries a roller 44 at its end and which is pressed under the effect of a spring 45 against the cam disc 41. Here the second control cylinder 46 is articulated at its ends with the excavator frame 1 and the boom 2 to extend parallel with the operating cylinder 8. The first and second control cylinders are connected by way of a line 47 that connects the cylinders on the piston rod side and a line 48 that connects the cylinders at the piston head or crown side. A line 49 branches off from the line 47 and leads to a pilot valve 50 of a main valve 51 for the operating cylinder 8 connected to the main valve by way of lines 52 and 53. A line 54 branches off from the line 48 that connects the two control cylinders and leads to the second pilot valve 55 of the main valve 51. When the main valve 51 is actuated the operating cylinder 8 is connected to the pump 26 which may preferably be the same pump as supplies pressurised oil to the operating cylinder 10 according to FIG. 1. In the lines 58 and 59 coming from the central control there is equally a twinned check valve 60 interposed. The positive control can be disabled by means of the cocks 61 and 62 for the individual control of the operating cylinders by hand.

From FIGS. 1 and 2 it may be seen that during movement of the bucket in a direction from or towards the excavator frame, during which it is guided parallel, the boom 2 must carry out a pendulum movement upwards and downwards. In the middle of the three positions of the bucket shown in FIG. 2 the boom 2 is raised higher than in the other two positions. This means that for the positive or constrained parallel guidance of the bucket, the angle between the excavator frame and the boom must first become smaller, then again greater or vice versa. This circumstance is taken into account in the shaping of the control curve 41*a* at the periphery of the cam disc 41. The cam disc 41 is consequently so constructed that when the dipper boom 4 swings in towards the excavator frame 1 the piston rod 43 of the first control cylinder 42 is retracted into the cylinder, whereby the swept volume forced out on the piston head or crown side flows via the line 48 into the second control cylinder 46 on its piston head or crown side and the resulting change in pressure simultaneously activates the pilot valve 55 so that operating cylinder 8 is subjected to pressure via the main valve 51 and raises the boom 2 by a predetermined amount. The control curve 41*a* of the cam disc 41 has at a predetermined position a maximal radial distance from the axis of rotation 3 and thereafter this radial distance becomes smaller again so that the above-described movement of the piston rod 43 of the first control cylinder and the resulting movement of the boom 2 reverse in direction. At this point of reversal the boom is raised exactly as far as is necessary for the parallel guidance of the bucket during the movement.

Since the first and second control means control two different movements mutually independently, it is also possible to provide only one or the other control means and to undertake the second movement required for the parallel guidance of the bucket by manual control. However, this requires once again greater routine or experience from the operator of the excavator since then the manual control must be carried out exactly as accurately as the positive or forced control through the above described control means so that the single control means present should "make sense". Preferably, the excavator is accordingly provided both with the first and with the second control means.

What is claimed is:

1. A hydraulic dredger/excavator of the type having an excavator frame, a boom swivellably journalled at the excavator frame and a first hydraulic cylinder therebetween, a dipper boom pivotally connected to the boom and a second hydraulic cylinder therebetween, a bucket pivotally connected to the end of the pivotable dipper boom and a third hydraulic cylinder therebetween, and having a control device for forcedly changing the angular position of the bucket with respect to the dipper boom and the angular position of the boom with respect to the excavator frame in dependence on manually controlling the hydraulic cylinder for varying the angle between the boom and the dipper boom, in order to move the bucket so as to maintain a position parallel to itself, the control device comprising cam means having control surface means, the cam means lying adjacent the axis of rotation of the dipper boom relative to the boom, and control means for effecting a follow-up control working with comparison of index value and actual value and acting on the hydraulic cylinder for varying the angle between the dipper boom and the bucket and on the hydraulic cylinder for varying the angle between the boom and the excavator frame, the control means having means for mechanically scanning the control surface means of the cam means, which at any point corresponds to the value of said angular position respectively, at which the bucket moves along a path so as to maintain a position parallel to itself.

2. The dredger/excavator according to claim 1, wherein said control means comprises first and second control means for respectively varying the angle between the dipper boom and the bucket and between the frame and the boom, each said first and second control means comprising: a double-acting first control cylinder coupled to a pressure fluid system and including said scanning means; a double-acting second control cylinder arranged and articulated in parallel with one of said third and first cylinders; a hydraulic line connecting said first and second control cylinders on the piston rod side thereof; a hydraulic line connecting said control cylinders on the crown or piston head side thereof; a main valve for controlling said first, second and third cylinders; said lines being respectively connected with pilot valves of said main valve; said pilot valves being effective to switch the main valve between two opposite directions, and being responsive to changes in hydraulic pressure at one or the other side of said first control cylinder.

3. The dredger/excavator according to claim 2, wherein said cam means comprise cam discs respectively associated with said first and second control means, each said first control cylinder having a piston rod resiliently engaging said respective cam discs, and each said cam disc and said first control cylinder being fixedly mounted on the boom and the dipper boom, respectively.

4. The dredger/excavator according to claim 3, wherein said each scanning means comprises a roller at the end of said piston rod displaceable along the respective cam surfaces of said discs as the angle between the boom and dipper boom varies.

5. The dredger/excavator according to claim 1, wherein said cam means comprises a cam disc, a link member interconnecting the bucket and dipper boom, said control means comprising a first control cylinder mounted on the dipper boom and a second control cylinder having one end connected to the dipper boom and the other end thereof connected to said link member, said third hydraulic cylinder lying parallel to said second control cylinder and being connected to said link member.

6. The dredger/excavator according to claim 5, wherein said cam disc is fixedly mounted at the end of the boom and includes a control surface, and said scanning means including a resiliently biased roller on the end of the piston rod of said first control cylinder in rolling engagement with said control surface, the radial distance of said control surface varying between opposite ends thereof from said axis of rotation, said control surface being so shaped as to ensure that a change in angle between the boom and the dipper boom caused by pivotal movement forces a volume of hydraulic medium out of said first control cylinder which effects a change in the effective length of said second control cylinder that takes up said volume, the magnitude of said effective length being that required for guiding the bucket in a parallel manner via the associated change in angle between the dipper boom and the bucket.

7. The dredger/excavator according to claim 1, wherein said cam means comprises a cam disc having a central surface, said control means comprising a first control cylinder mounted on the dipper boom and a second control cylinder having one end pivotally connected to the boom with the other end thereof pivotally connected to the frame, said second control cylinder end said first hydraulic cylinder being in parallel relationship.

8. The dredger/excavator according to claim 7, wherein said cam disc is fixedly mounted at the end of the boom, and the control surface thereof has a shape changing sign as it varies from one end to the other with its radial distance from said axis of rotation also varying with a maximum distance in the central region of the central surface, said scanning means including a resiliently biased roller at the end of said piston rod of said first control cylinder in rolling engagement with said control surface, said surface being such that when the angle between the boom and the dipper boom changes when the latter is swivelled, a volume of hydraulic fluid is forced out of said first control cylinder and causes a change in the effective length of said second control cylinder that takes up said volume, the magnitude of said change in length being exactly that required for the parallel guidance of the bucket, via the associated change in angle between the boom and the frame, and wherein during movement of the bucket toward or away from the frame the change in angle therebetween changes its sign.

* * * * *